US010217437B2

(12) United States Patent
Zhang et al.

(10) Patent No.: US 10,217,437 B2
(45) Date of Patent: Feb. 26, 2019

(54) METHOD AND APPARATUS OF COLOR CONVERSION FROM RED-GREEN-BLUE COLOR SPACE TO RED-GREEN-BLUE-WHITE COLOR SPACE ON INPUT IMAGE

(71) Applicant: NOVATEK Microelectronics Corp., Hsin-Chu (TW)

(72) Inventors: Lei Zhang, Xi'an (CN); Danyu Fu, Xi'an (CN); Yuanjia Du, Jinan (CN); Yen-Tao Liao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 3 days.

(21) Appl. No.: 15/448,508

(22) Filed: Mar. 2, 2017

(65) Prior Publication Data

US 2018/0240436 A1 Aug. 23, 2018

(30) Foreign Application Priority Data

Feb. 22, 2017 (CN) ..... 2017 1 0096289

(51) Int. Cl.
*G09G 5/02* (2006.01)

(52) U.S. Cl.
CPC ..... *G09G 5/02* (2013.01); *G09G 2340/06* (2013.01)

(58) Field of Classification Search
None
See application file for complete search history.

(56) References Cited

U.S. PATENT DOCUMENTS

2008/0204480 A1* 8/2008 Van Mourik ..... G09G 3/2003 345/690
2012/0306947 A1* 12/2012 Kim ..... G09G 3/3233 345/694
2013/0222414 A1* 8/2013 Ito ..... G09G 5/02 345/600
2014/0176623 A1* 6/2014 Inoue ..... G09G 3/2003 345/690
2015/0348506 A1* 12/2015 Ooga ..... G09G 5/10 345/205
2015/0371605 A1* 12/2015 Wu ..... G09G 5/02 345/604
2016/0132999 A1* 5/2016 Kwon ..... G06T 5/008 345/593
2016/0148579 A1* 5/2016 Kimura ..... G09G 3/3607 345/694
2017/0006272 A1* 1/2017 Ioka ..... H04N 1/6027
2017/0061925 A1* 3/2017 Kim ..... G09G 3/2074

* cited by examiner

*Primary Examiner* — Xiao M Wu
*Assistant Examiner* — Steven Z Elbinger
(74) *Attorney, Agent, or Firm* — Winston Hsu

(57) ABSTRACT

A method of color conversion from a red-green-blue (RGB) color space to a red-green-blue-white (RGBW) color space on an input image includes calculating RGB and white gains with respect to an image block of the input image, calculating RGB and white gain with respect to a pixel of the image block, wherein the white gain with respect to the pixel of the image block is adjusted based on the RGB gain with respect to the pixel of the image block, and performing the RGB to RGBW color conversion based on the RGB and white gain with respect to the pixel of the image block, which improves local color and detail performance of an output image corresponding to the input image.

12 Claims, 3 Drawing Sheets

METHOD AND APPARATUS OF COLOR CONVERSION FROM RED-GREEN-BLUE COLOR SPACE TO RED-GREEN-BLUE-WHITE COLOR SPACE ON INPUT IMAGE

BACKGROUND OF THE INVENTION

1. Field of the Invention

The present invention relates to a method and apparatus of color conversion from a red-green-blue (RGB) color space to a red-green-blue-white (RGBW) color space on an input image.

2. Description of the Prior Art

Currently, an LCD (Liquid Crystal Display) panel or an organic light emitting diode (OLED) display panel utilizes a red (R) sub-pixel unit, a green (G) sub-pixel unit, and a blue (B) sub-pixel unit to form one pixel unit. The LCD panel controls an R data of the red sub-pixel unit, a G data of the green sub-pixel unit, and a B data of the blue sub-pixel to mix a required color for displaying.

With the development of information technology, a variety of demands for the display panel are increased, such as high transmittance, low power consumption, and good image quality. The light transmittance and mixing efficiency of the current RGB color mixing method is relative low such that the power consumption is large and limits the improvement of the display panel. Accordingly, a display panel having four-color sub-pixel units formed by a red (R) sub-pixel unit, a green (G) sub-pixel units, a blue (B) sub-pixel unit and a fourth sub-pixel unit (for example, a white (W) sub-pixel unit) is designed in order to improve the display quality of the display panel based on three-color sub-pixel units.

In the prior art, and in a display panel having the four-color sub-pixel units, a minimum value of the RGB values is set as an output value of W (white) color. In this case, with the adding of the white sub-pixel unit, the brightness of the display panel having the four-color sub-pixel units is greatly increased, and the power consumption is also reduced. However, because the increase of the brightness, the display panel having the four-color sub-pixel units comparing with the display panel having three-color sub-pixel units is smaller in color gamut, and the color saturation is reduced, which results in worse local color performance. For example, the color saturation of a yellow object in an RGB input image having white background (i.e., high brightness and luminance) may be converted into khaki or yellow-green. Further, local detail performance may be damaged due to inappropriate white sub-pixel units.

SUMMARY OF THE INVENTION

It is therefore an objective of the present invention to provide a method and apparatus of color conversion from a red-green-blue (RGB) color space to a red-green-blue-white (RGBW) color space on an input image.

Before performing RGB to RGBW color space conversion, the present invention calculates a first RGB gain and a first W gain with respect to an image block of an input image, wherein the first RGB gain and the first W gain with respect to the image block are adjusted according to a target color composition of the image block. In one embodiment, the target color is yellow. Then, the present invention calculates a plurality of second RGB gains and a plurality of second W gains with respect to a plurality of pixels of the image block, wherein the plurality of second RGB gains and the plurality of second W gains are calculated by performing low pass filtering and interpolation to the first RGB gain and the first W gain, and the plurality of second W gains are adjusted according to the plurality of second RGB gains. Finally, the RGB to RGBW color conversion is performed based on the plurality of second RGB gains and the plurality of adjusted second W gains, which improves local color and detail performance of an output image corresponding to the input image.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
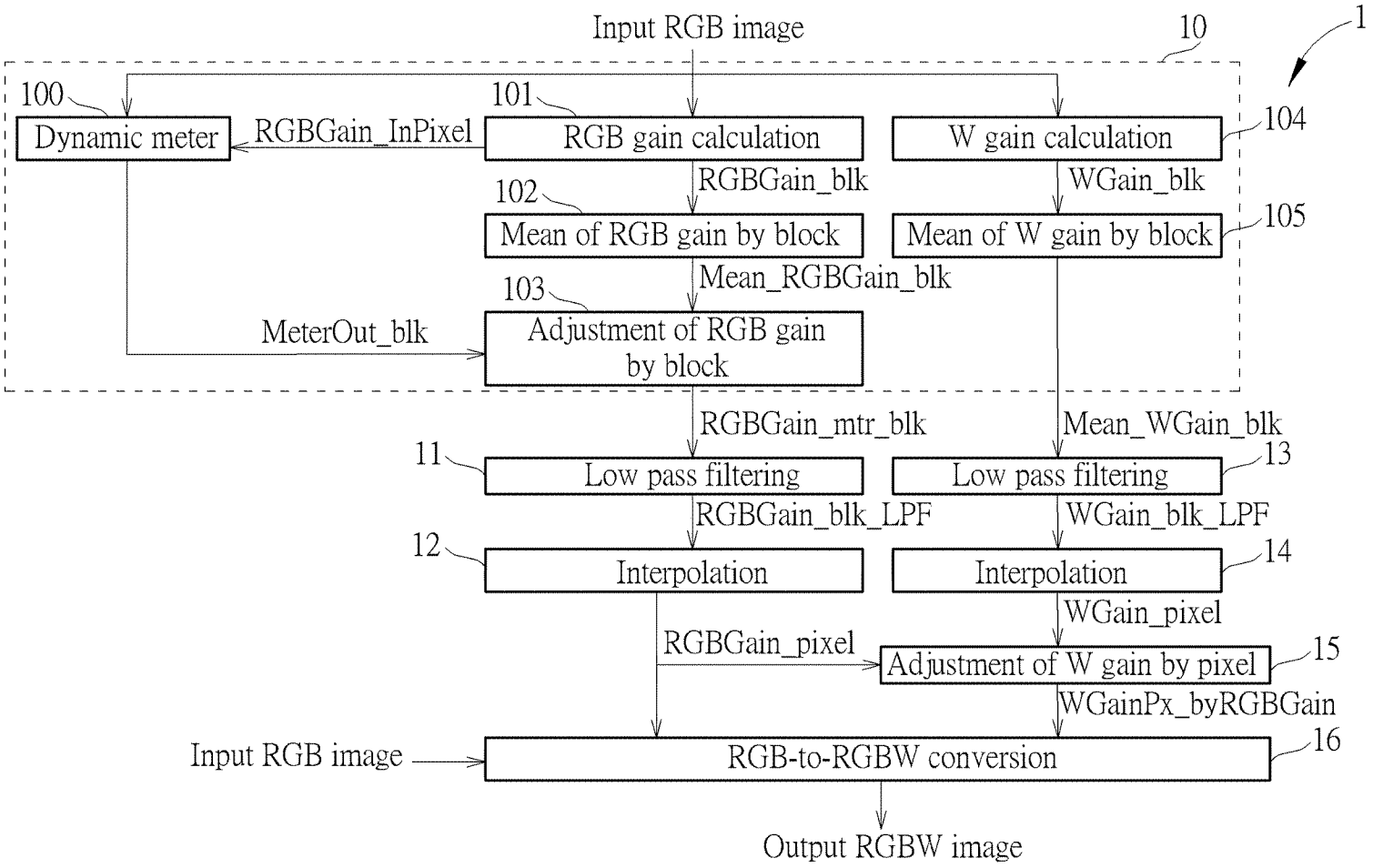
FIG. 1 is a functional block diagram of an image processing system according to an embodiment of the present invention.

FIG. 1 is a functional block diagram of an image processing system 1 according to an embodiment of the present invention. The image processing system 1 performs color conversion to an input image from a red-green-blue (RGB) color space to a red-green-blue-white (RGBW) color space (hereinafter abbreviated "RGB-to-RGBW conversion"), and includes processing modules 10, 11, 12, 13, 14, 15 and 16, wherein the processing module 10 includes sub-modules 100, 101, 102, 103, 104 and 105.

Operations of the image processing system 1 can be summarized into three steps. Specifically, before performing RGB-RGBW conversion, the image processing system 1 firstly calculates a first RGB gain and a first W gain with respect to an image block of the input RGB image based on a target color composition of the image block, and secondly calculates a second RGB gain and a second W gain with respect to a pixel of the image block, wherein the second W gain with respect to the pixel of the image block is adjusted based on the second RGB gain with respect to the pixel of the image block. Finally, the image processing system 1 performs the RGB-to-RGBW conversion based on the second RGB gain and the adjusted second W gain to generate an output RGBW image, which improves local color and detail performance of the output RGBW image corresponding to the input RGB image.

Figure 2:
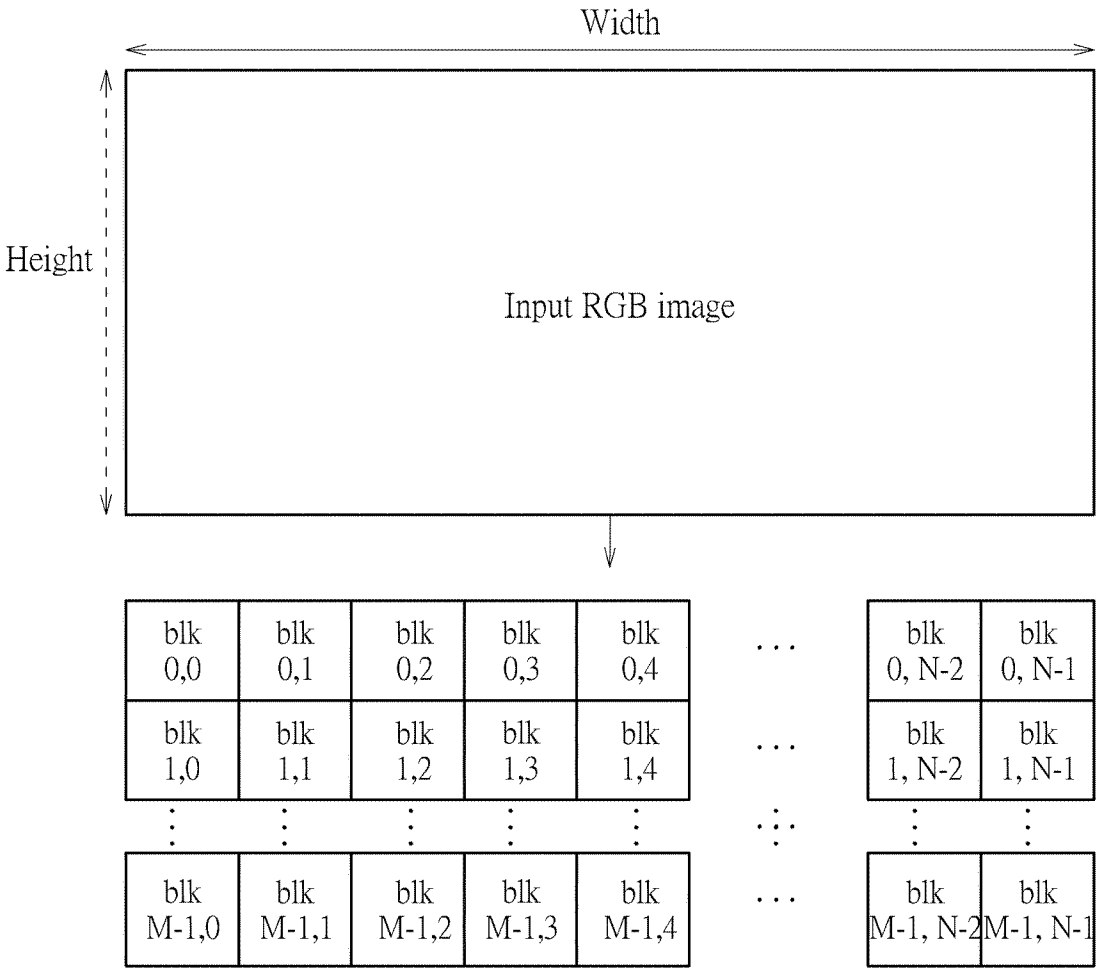
FIG. 2 illustrates a plurality of image blocks with respect to an input image.

When the input RGB image is inputted, the input RGB image may be divided into a plurality of RGB image blocks. For example, FIG. 2 illustrates a plurality of image blocks with respect to the input RGB image, wherein each of the image blocks may be labeled as (0,0)~(0,N), (1,0)~(1,N), . . . , and (M,0)~(M−1,N−1). Each of the image blocks may include M*N RGB pixel units, and the block sizes M and N may be arbitrary. In one embodiment, the image block may include 256*256 pixel units.

The processing module 10 aims at smoothing luminance difference between a white background and a color object of the input RGB image, which helps to reserve the perceived color brightness of the color object after the RGB-to-RGBW conversion. For processing one RGB image block, the processing module 10 calculates an RGB block gain parameter MeterOut_blk according to input RGB pixels of the image block of the input image, wherein the RGB block gain parameter MeterOut_blk indicates a target color composition of the input RGB pixels of the image block. In one embodiment, the target color is yellow. The processing module 10 calculates a first RGB block gain RGBGain_mtr_blk corresponding to the image block according to the RGB block gain parameter MeterOut_blk corresponding to the image block and the input RGB pixels of the image block, which protects color gamut and saturation of the color object in the image block. Meanwhile, the processing module 10 calculates a first white block gain Mean_WGain_blk corresponding to the image block according to the input RGB pixels of the image block.

In detail, in the processing module 10, the sub-module 101 calculates a plurality of second RGB pixel gains RGBGain_InPixel of the input RGB pixels. The sub-module 100 converts the input RGB pixels of the image block from the RGB color space into a YCbCr color space to generate a plurality of luminance values (Y) of the input RGB pixels.

Then, the sub-module 100 calculates a plurality of luminance difference values according to the plurality of second RGB pixel gains RGBGain_InPixel and the plurality of luminance values (Y) of the input RGB pixels, wherein the luminance difference values are calculated according to a function (1):

$$\text{LumaDiff}=Y*(2-\text{RGBGain_InPixel})$$

Wherein 1<RGBGain_InPixel <2, and LumaDiff is a parameter to differentiate between colors and grayscales, which is related to the luminance corresponding to an input pixel.

The sub-module 100 accumulates the plurality of luminance difference values (i.e., LumaDiff) obtained by the function (1) to calculate the RGB block gain parameter MeterOut_blk. Note that, a higher value of the RGB block gain parameter MeterOut_blk results in a greater target color composition of the input RGB image block.

The sub-modules 101, 102 and 103 aim at generating the RGB gain with respect to the image block in consideration of the RGB block gain parameter MeterOut_blk. It is desirable to make the image block with more target color composition to have a high RGB gain reaching to a threshold when performing the RGB-to-RGBW conversion, which helps to reserve the perceived color brightness of the color object after the RGB-to-RGBW conversion. In one embodiment, a greater value of the MeterOut_blk with respect to the image block results in a stronger degree of adjustment for the image block.

In detail, the sub-module 101 further calculates a second RGB block gain RGBGain_blk according to the input RGB pixels of the image block. The sub-module 102 averages the second RGB block gain RGBGain_blk by a number of the input RGB pixels (e.g., M*N) to generate a third RGB block gain Mean_RGBGain_blk corresponding to the image block.

The sub-module 103 calculates the first RGB block gain RGBGain_mtr_blk corresponding to the image block according to the third RGB block gain Mean_RGBGain_blk and the block gain parameter MeterOut_blk. The sub-module 103 performs a bit shift operation to the block gain parameter MeterOut_blk by a bit shift operator reg_shift_bits=12, and calculates a fourth RGB block gain RGBGain_thr_blk according to the block gain parameter MeterOut_blk. The fourth RGB block gain RGBGain_thr_blk is calculated according to a function (2):

$$\text{RGBGain_}thr_blk=2-\text{Min}[1,\text{MeterOut_}blk]$$

Wherein 1<RGBGain_thr_blk<2.

According to the function (2), the fourth RGB block gain RGBGain_thr_blk is close to 2 if the image block has a low luminance difference (i.e., the RGB block gain parameter MeterOut_blk is close zero), and the fourth RGB block gain RGBGain_thr_blk is 1 if the image block has a high luminance difference (i.e., the RGB block gain parameter MeterOut_blk is greater than 1).

The sub-module 103 further calculates the first RGB block gain RGBGain_mtr_blk according to a function (3):

$$\text{RGBGain_}mtr_blk=\text{Min}[\text{Mean_RGBGain_}blk,\text{RGBGain_}thr_blk]$$

According to the functions (2) and (3), for the image block having a low luminance difference (i.e., the high the fourth RGB block gain RGBGain_thr_blk), the second RGB block gain RGBGain_blk is adjusted to the third RGB block gain Mean_RGBGain_blk. For the image block having a high luminance difference (i.e., the low fourth RGB block gain RGBGain_thr_blk), the second RGB block gain RGBGain_blk is adjusted to the fourth RGB block gain RGBGain_thr_blk obtained by the high RGB block gain parameter MeterOut_blk.

Therefore, by the operations of the sub-modules 101, 102 and 103, the second RGB block gain RGBGain_blk with respect to the image block is adjusted in consideration of the RGB block gain parameter MeterOut_blk, which helps to reserve the perceived color brightness of the target color object after the RGB-to-RGBW conversion The sub-modules 104 and 105 aim at generating the first white block gain Mean_WGain_blk. In detail, the sub-module 104 calculates a second white block gain WGain_blk corresponding to the image block according to the input RGB pixels of the image block, and then averages the second white block gain WGain_blk by the number of the input RGB pixels M*N, to calculate the first white block gain Mean_WGain_blk corresponding to the image block.

In order to eliminate contour noises and ensure the content of in the image block looks smooth, the processing module 11 performs a low pass filtering operation to the first RGB block gain RGBGain_mtr_blk to generate a filtered RGB block gain RGBGain_blk_LPF corresponding to the image block. Then, the processing module 12 performs an interpolation operation to convert the filtered RGB block gain RGBGain_blk_LPF corresponding to the image block into a plurality of first RGB pixel gains RGBGain_pixel corresponding to the input RGB pixels of the image block.

Similarly, the processing module 13 performs a low pass filtering operation to the first white block gain Mean_WGain_blk, to generate a filtered white block gain WGain_blk_LPF corresponding to the image block. Then, the processing module 14 performs an interpolation operation to convert the filtered white block gain WGain_blk_LPF corresponding to the image block into a plurality of first white pixel gains WGain_pixel corresponding to the input RGB pixels of the image block.

The processing module 15 aims at adjusting the plurality of first white pixel gains WGain_pixel in consideration of the plurality of first RGB pixel gains RGBGain_pixel, which protects the color saturation of the plurality of first RGB pixel gains RGBGain_pixel. In detail, the processing module 15 calculates a plurality of second white pixel gains WGainPx_byRGBGain according to the plurality of first RGB pixel gains RGBGain_pixel and the plurality of first white pixel gains WGain_pixel corresponding to the input RGB pixels of the image block. In one embodiment, the processing module 15 calculates the plurality of second white pixel gains WGainPx_byRGBGain according to a function (4):

$$W\text{Gain}Px\text{_byRGBGain}=W\text{Gain_pixel}*(\text{RGBGain_pixel}-1)$$

Wherein 1<RGBGain_pixel <2.

According to the function (4), the plurality of first white pixel gains WGain_pixel is decreased by multiplying with a number less than 1, which protects the color saturation of the plurality of first RGB pixel gains RGBGain_pixel.

Finally, the processing module 16 performs the RGB2RGBW conversion according to the input RGB pixels of the image block, the plurality of first RGB pixel gains RGBGain_pixel and the plurality of second white pixel gains WGainPx_byRGBGain, to generate a plurality of output RGBW pixels of the image block. The RGB-to-RGBW conversion operation shall be well known in the art, which is not narrated.

Figure 3:
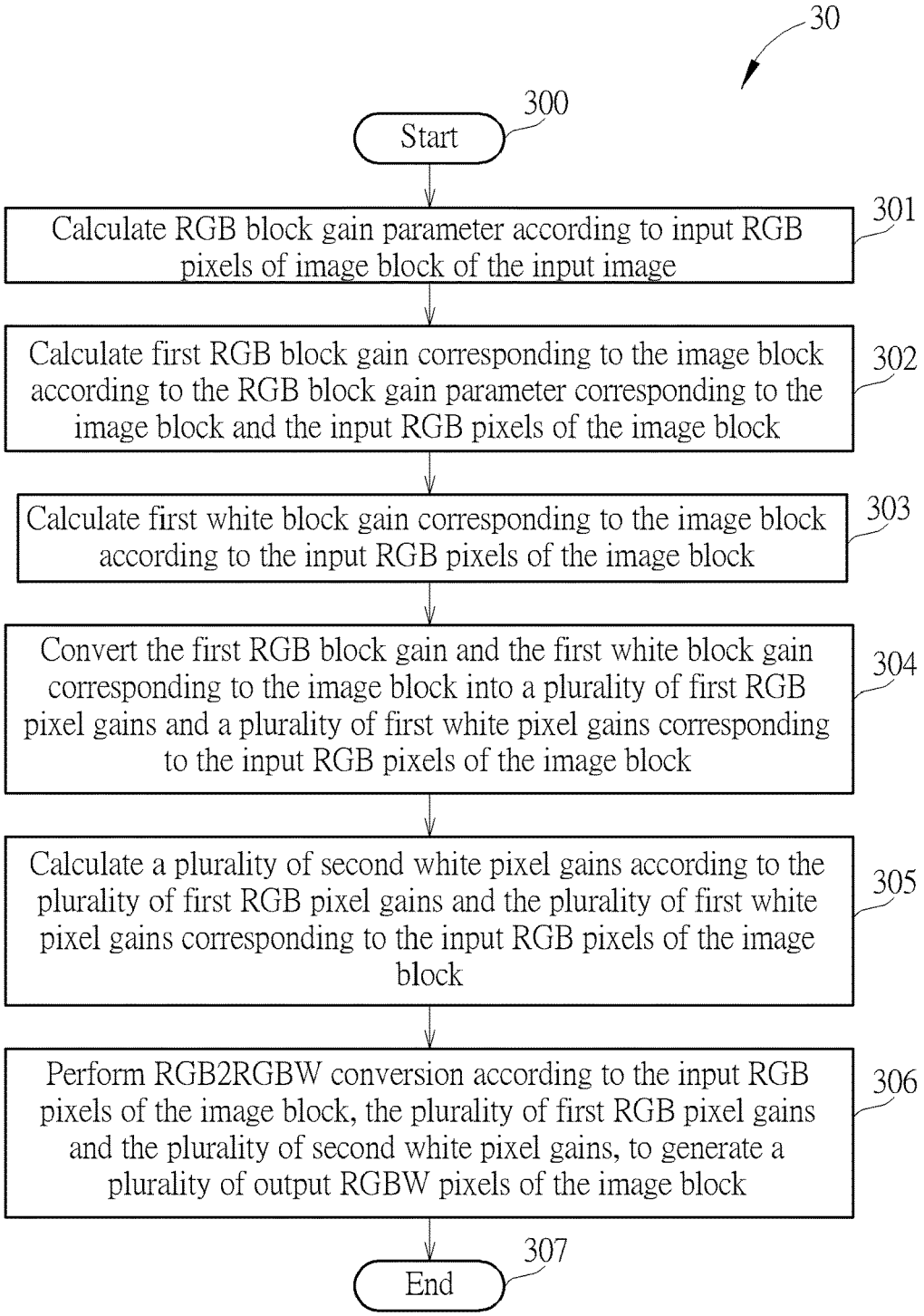
FIG. 3 is a flowchart of a process of color conversion from RGB color space to RGBW color space according to an embodiment of the present invention.

Operations of the image processing system 1 can by summarized into a process 30 of color conversion from RGB color space to RGBW color space according to an embodiment of the present invention. As shown in FIG. 3, the process 30 may be used for the image processing system 1 of an electronic device with display function, such as a television set, a display device, a mobile phone, tablet computer, a desktop computer, and so on. The process 30 may be compiled into a program code to be stored in a memory device and accessed by a processing device of the electronic device. The process 30 includes the following steps:

Step 300: Start.

Step 301: Calculate an RGB block gain parameter according to input RGB pixels of an image block of the input image.

Step 302: Calculate a first RGB block gain corresponding to the image block according to the RGB block gain parameter corresponding to the image block and the input RGB pixels of the image block.

Step 303: Calculate a first white block gain corresponding to the image block according to the input RGB pixels of the image block.

Step 304: Convert the first RGB block gain and the first white block gain corresponding to the image block into a plurality of first RGB pixel gains and a plurality of first white pixel gains corresponding to the input RGB pixels of the image block.

Step 305: Calculate a plurality of second white pixel gains according to the plurality of first RGB pixel gains and the plurality of first white pixel gains corresponding to the input RGB pixels of the image block.

Step 306: Perform a color conversion operation from RGB color space to RGBW color space according to the input RGB pixels of the image block, the plurality of first RGB pixel gains and the plurality of second white pixel gains, to generate a plurality of output RGBW pixels of the image block.

Step 307: End.

In the process 30, Step 301 is performed by the sub-module 100, Step 302 is performed by the sub-modules 101, 102 and 103, Step 304 is performed by the modules 11, 12, 13 and 14, Step 305 is performed by the module 15, and Step 306 is performed by the module 16. Detailed operations of the process 30 can be obtained by referring to descriptions of FIG. 1.

To sum up, before performing RGB to RGBW color space conversion, the present invention calculates the RGB gain and the W gain with respect to an image block of an input image, wherein the RGB gain with respect to the image block is adjusted based on a target color composition of the image block. The present invention then calculates the RGB gain and the W gain with respect to a pixel of the image block, wherein the W gain with respect to the pixel of the image block is adjusted based on the RGB gain with respect to the pixel of the image block. Finally, the RGB to RGBW color conversion is performed based on the RGB gain and the W gain with respect to the pixel of the image block, which improves local color and detail performance of an output image corresponding to the input image.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of color conversion from a red-green-blue (RGB) color space to a red-green-blue-white (RGBW) color space on an input image, wherein the input image comprises a plurality of image blocks, the method comprising:

determining a base RGB block gain and an RGB block gain parameter according to input RGB pixels of an image block of the input image, wherein the RGB block gain parameter indicates a total luminance difference contributed by the input RGB pixels of the image block and a target color composition among the input RGB pixels;

adjusting the base RGB block gain according to the RGB block gain parameter to generate a first RGB block gain corresponding to the image block;

calculating a first white block gain corresponding to the image block according to the input RGB pixels of the image block;

converting the first RGB block gain and the first white block gain corresponding to the image block into a plurality of first RGB pixel gains and a plurality of first white pixel gains corresponding to the input RGB pixels of the image block;

multiplying the plurality of first white pixel gains with a difference between the plurality of first RGB pixel gain and a first threshold to generate a plurality of second white pixel gains, wherein the first threshold is within a luminance transmittance range between the RGB color space and the RGBW color space; and performing a color conversion operation from RGB color space to RGBW color space according to the input RGB pixels of the image block, the plurality of first RGB pixel gains and the plurality of second white pixel gains, to generate a plurality of output RGBW pixels of the image block.

2. The method of claim 1, wherein determining the RGB block gain parameter according to the input RGB pixels of the image block comprises:

calculating a plurality of second RGB pixel gains of the input RGB pixels, wherein each one of the plurality of second RGB pixel gains of the input RGB pixels is greater than 1 and less than 2;

converting the input RGB pixels of the image block from the RGB color space into a YCbCr color space, to generate a plurality of luminance values of the input RGB pixels;

multiplying the plurality of luminance values of the input RGB pixels with a plurality of differences between a second threshold and the plurality of second RGB pixel gains to generate a plurality of luminance difference values of the input RGB pixels; and accumulating the plurality of luminance difference values of the input RGB pixels to generate the RGB block gain parameter.

3. The method of claim 1, wherein adjusting the base RGB block gain according to the RGB block gain parameter to generate the first RGB block gain comprises:

calculating a second RGB block gain according to the input RGB pixels of the image block, wherein the base RGB block gain is the second RGB block gain;

averaging the second RGB block gain by a number of the input RGB pixels to generate a third RGB block gain corresponding to the image block; and selecting a minimum among the third RGB block gain and a fourth RGB block gain corresponding to the image block to generate the first RGB block gain corresponding to the image block.

4. The method of claim 3, wherein calculating the first RGB block gain corresponding to the image block according to the third RGB block gain and the RGB block gain parameter comprises:

performing a bit shift operation to the RGB block gain parameter by a bit shift operator; and calculating a difference between a luminance transmittance value of the RGBW color space and a minimum among a luminance transmittance value of the RGB color space and the RGB block gain parameter after the bit shift operation to generate the fourth RGB block gain.

5. The method of claim 1, wherein calculating the first white block gain corresponding to the image block comprises:

calculating a second white block gain corresponding to the image block according to the input RGB pixels of the image block; and averaging the second white block gain by a number of the input RGB pixels to calculate the first white block gain corresponding to the image block.

6. The method of claim 1, wherein converting the first RGB block gain and the first white block gain corresponding to the image block into the plurality of first RGB pixel gains and the plurality of first white pixel gains corresponding to the input RGB pixels of the image block comprises:

performing a low pass filtering operation to the first RGB block gain and the first white block gain, to generate a filtered RGB block gain and a filtered white block gain corresponding to the image block; and performing an interpolation operation to the filtered RGB block gain and the filtered white block gain, to generate the plurality of first RGB pixel gains and the plurality of first white pixel gains corresponding to the input RGB pixels of the image block.

7. An electronic device for performing color conversion comprising:

a processing device; and a memory unit, coupled to the processing device, for storing a program code to instruct the processing device executing a process of color conversion from a red-green-blue (RGB) color space to a red-green-blue-white (RGBW) color space on an input image, wherein the input image comprises a plurality of image blocks, wherein the process comprises:

determining a base RGB block gain and an RGB block gain parameter according to input RGB pixels of an image block of the input image, wherein the RGB block gain parameter indicates a total luminance difference contributed by the input RGB pixels of the image block and a target color composition among the input RGB pixels;

adjusting the base RGB block gain according to the RGB block gain parameter to generate a first RGB block gain corresponding to the image block;

calculating a first white block gain corresponding to the image block according to the input RGB pixels of the image block;

converting the first RGB block gain and the first white block gain corresponding to the image block into a plurality of first RGB pixel gains and a plurality of first white pixel gains corresponding to the input RGB pixels of the image block;

multiplying the plurality of first white pixel gains with a difference between the plurality of first RGB pixel gain and a first threshold to generate a plurality of second white pixel gains, wherein the first threshold is within a luminance transmittance range between the RGB color space and the RGBW color space; and performing a color conversion operation from RGB color space to RGBW color space according to the input RGB pixels of the image block, the plurality of first RGB pixel gains and the plurality of second white pixel gains, to generate a plurality of output RGBW pixels of the image block.

8. The electronic device of claim 7, wherein determining the RGB block gain parameter according to the input RGB pixels of the image block comprises:

calculating a plurality of second RGB pixel gains of the input RGB pixels, wherein each one of the plurality of second RGB pixel gains of the input RGB pixels is greater than 1 and less than 2;

converting the input RGB pixels of the image block from the RGB color space into a YCbCr color space, to generate a plurality of luminance values of the input RGB pixels;

multiplying the plurality of luminance values of the input RGB pixels with a plurality of differences between a second threshold and the plurality of second RGB pixel gains to generate a plurality of luminance difference values of the input RGB pixels; and accumulating the plurality of luminance difference values of the input RGB pixels to generate the RGB block gain parameter.

9. The electronic device of claim 7, wherein adjusting the base RGB block gain according to the RGB block gain parameter to generate the first RGB block gain comprises:

calculating a second RGB block gain according to the input RGB pixels of the image block, wherein the base RGB block gain is the second RGB block gain;

averaging the second RGB block gain by a number of the input RGB pixels to generate a third RGB block gain corresponding to the image block; and selecting a minimum among the third RGB block gain and a fourth RGB block gain corresponding to the image block to generate the first RGB block gain corresponding to the image block.

10. The electronic device of claim 9, wherein calculating the first RGB block gain corresponding to the image block according to the third RGB block gain and the RGB block gain parameter comprises:

performing a bit shift operation to the RGB block gain parameter by a bit shift operator; and calculating a difference between a luminance transmittance value of the RGBW color space and a minimum among a luminance transmittance value of the RGB color space and the RGB block gain parameter after the bit shift operation to generate the fourth RGB block gain.

11. The electronic device of claim 7, wherein calculating the first white block gain corresponding to the image block comprises:

calculating a second white block gain corresponding to the image block according to the input RGB pixels of the image block; and averaging the second white block gain by a number of the input RGB pixels, to calculate the first white block gain corresponding to the image block.

12. The electronic device of claim 7, wherein converting the first RGB block gain and the first white block gain corresponding to the image block into the plurality of first RGB pixel gains and the plurality of first white pixel gains corresponding to the input RGB pixels of the image block comprises:

performing a low pass filtering operation to the first RGB block gain and the first white block gain, to generate a filtered RGB block gain and a filtered white block gain corresponding to the image block; and performing an interpolation operation to the filtered RGB block gain and the filtered white block gain, to generate the plurality of first RGB pixel gains and the plurality of first white pixel gains corresponding to the input RGB pixels of the image block.

* * * * *